US009966707B2

(12) United States Patent
Hildebrand

(10) Patent No.: US 9,966,707 B2
(45) Date of Patent: May 8, 2018

(54) DEVICE FOR FASTENING AN ATTACHED PART, IN PARTICULAR IN THE FORM OF A MOTOR VEHICLE ANTENNA

(75) Inventor: Rudolf Hildebrand, Holzkirchen (DE)

(73) Assignee: Kathrein-Werke KG, Rosenheim (DE)

( * ) Notice: Subject to any disclaimer, the term of this patent is extended or adjusted under 35 U.S.C. 154(b) by 645 days.

(21) Appl. No.: 11/607,084

(22) Filed: Dec. 1, 2006

(65) Prior Publication Data

US 2008/0131199 A1 Jun. 5, 2008

(51) Int. Cl.

| | |
|---|---|
| ***H01Q 1/00*** | (2006.01) |
| ***H01R 13/74*** | (2006.01) |
| ***H01Q 1/12*** | (2006.01) |
| ***H01Q 1/32*** | (2006.01) |
| *H01R 24/52* | (2011.01) |

(52) U.S. Cl.

CPC ..... *H01R 13/745* (2013.01); *H01Q 1/1214* (2013.01); *H01Q 1/1242* (2013.01); *H01Q 1/3275* (2013.01); *H01R 24/52* (2013.01); *H01R 2201/02* (2013.01); *H01R 2201/26* (2013.01); *Y10T 403/75* (2015.01)

(58) Field of Classification Search

CPC ..... H01Q 1/3275; F16B 13/066
USPC ..... 403/197, 252, 408.1; 343/711, 713, 715; 439/353, 916

See application file for complete search history.

(56) References Cited

U.S. PATENT DOCUMENTS

| | | | | |
|---|---|---|---|---|
| 6,077,115 | A * | 6/2000 | Yang et al. | 439/567 |
| 6,078,300 | A * | 6/2000 | Militz et al. | 343/713 |
| 6,132,244 | A * | 10/2000 | Leeman | H01R 23/688 439/541.5 |
| 7,088,297 | B2 * | 8/2006 | Nakano et al. | 343/713 |
| 7,336,231 | B2 * | 2/2008 | Hayashi et al. | 343/713 |
| 7,338,316 | B2 * | 3/2008 | Blickle | 439/546 |
| 7,429,958 | B2 * | 9/2008 | Lindackers et al. | 343/713 |
| 2003/0089834 | A1 | 5/2003 | Hough | |
| 2006/0038729 | A1 * | 2/2006 | Ohno et al. | 343/713 |
| 2006/0077110 | A1 | 4/2006 | Blickle | |
| 2006/0103579 | A1 * | 5/2006 | Blickle | 343/713 |

FOREIGN PATENT DOCUMENTS

| | | | |
|---|---|---|---|
| DE | 19640110 | A1 * | 4/1998 |
| DE | 298 14 054 | | 11/1998 |
| DE | 100 09 978 | | 9/2001 |
| DE | 201 17 628 | | 3/2002 |
| DE | 202 03 914 | | 7/2002 |
| DE | 202 04 863 | | 10/2002 |
| DE | 10249814 | | 5/2003 |
| DE | 10210593 | A1 | 9/2003 |
| DE | 10255549 | A1 * | 6/2004 |
| DE | 103 13 664 | | 10/2004 |

(Continued)

OTHER PUBLICATIONS

"Road Vehicles—50 ohm radio frequency interface, Part 1: General requirements" (Mar. 1, 2006).

*Primary Examiner* — Victor L MacArthur
(74) *Attorney, Agent, or Firm* — Nixon & Vanderhye P.C.

(57) ABSTRACT

A device for fastening an attached part, in particular in the form of a motor vehicle antenna, to a fitting wall provided with a fitting opening, in the form of a bodywork metal sheet. Tensioning structure is located in a region of the fitting opening and is arranged to secure the attached part relative to the fitting wall.

17 Claims, 11 Drawing Sheets

(56) References Cited

FOREIGN PATENT DOCUMENTS

| | | | | |
|---|---|---|---|---|
| DE | 102004037813 | B3 | * | 10/2005 |
| DE | 10 2005 029 686 | | | 8/2006 |
| DE | 102005029686 | A1 | | 8/2006 |
| DE | 102006015923 | A1 | * | 11/2006 |
| EP | 0 891 002 | | | 10/2002 |
| EP | 0 758 802 | | | 12/2002 |
| EP | 1 641 068 | | | 3/2006 |
| EP | 1 641 069 | | | 3/2006 |
| EP | 1650827 | A2 | * | 4/2006 |
| FR | 2668528 | A1 | * | 4/1992 |
| WO | WO03032436 | A1 | | 4/2003 |
| WO | WO 2004086556 | A1 | * | 10/2004 |
| WO | WO2006108589 | A1 | | 10/2006 |

* cited by examiner

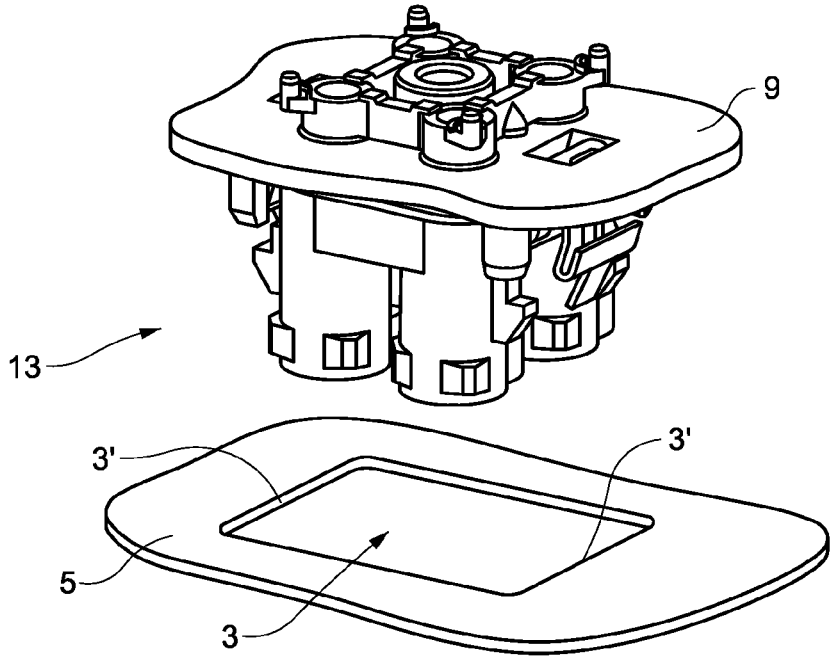
Fig. 6
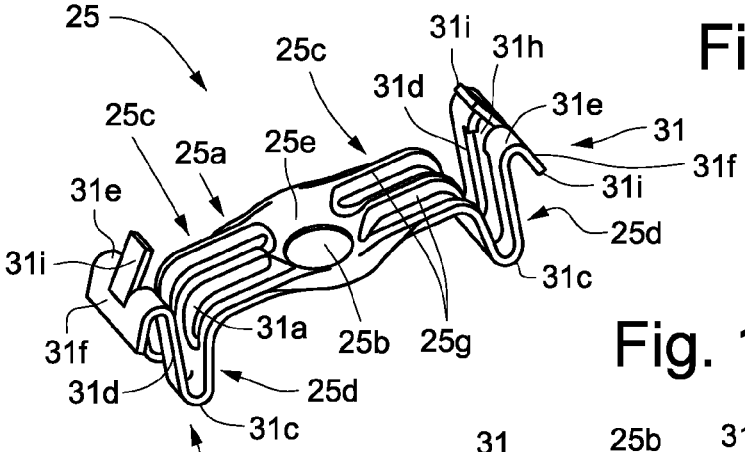
Fig. 11
Fig. 12
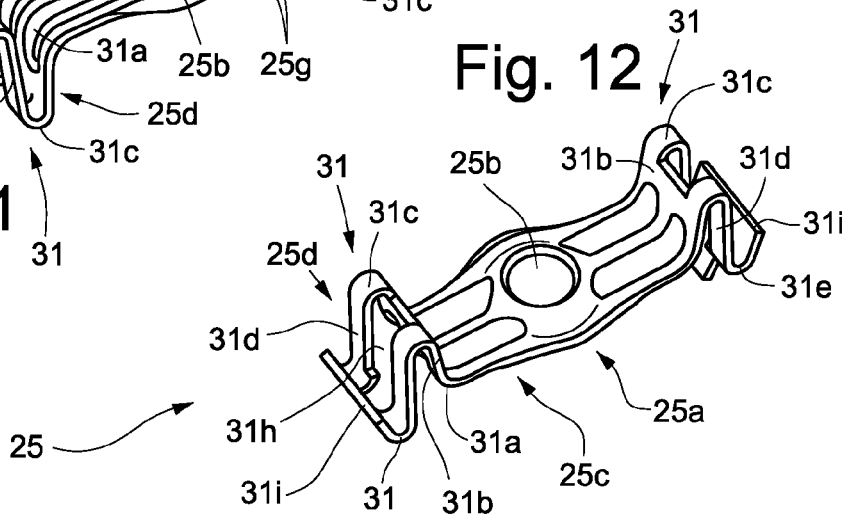

Fig. 8a
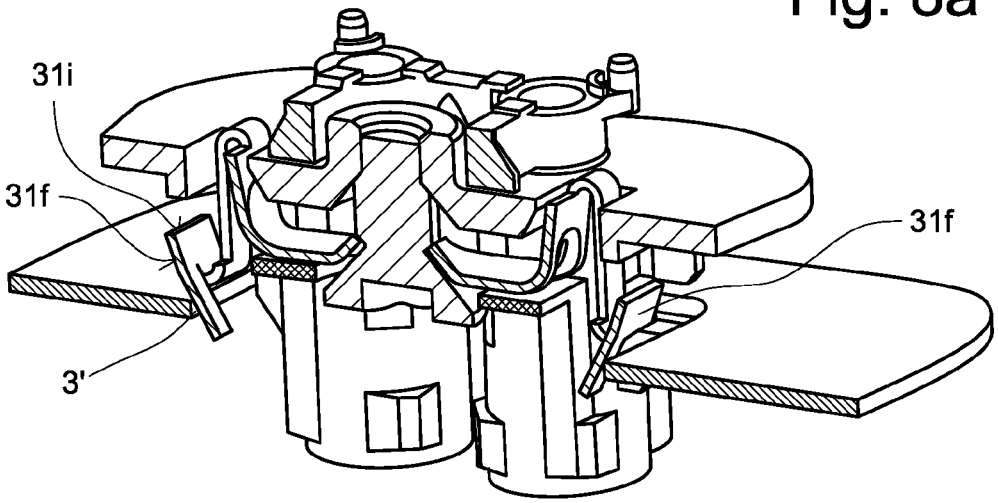
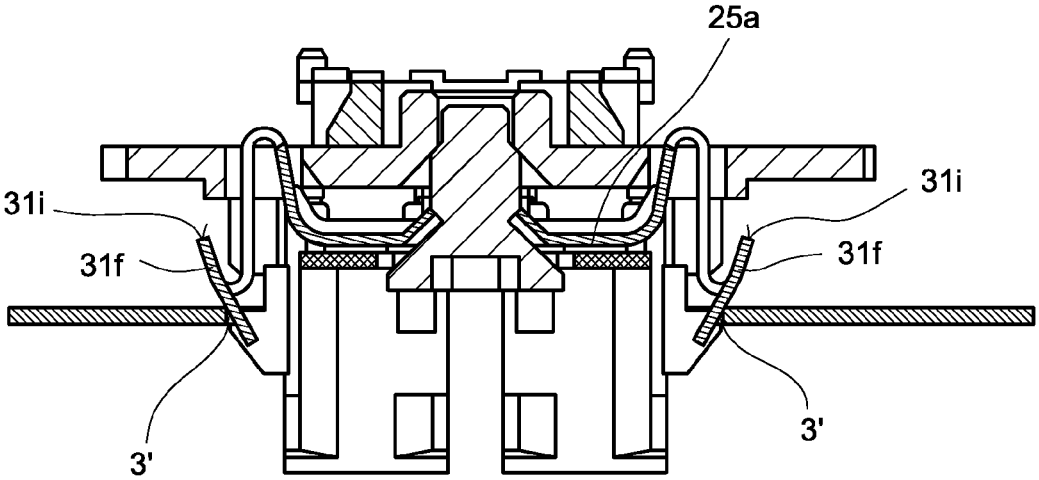
Fig. 8b

Fig. 9a
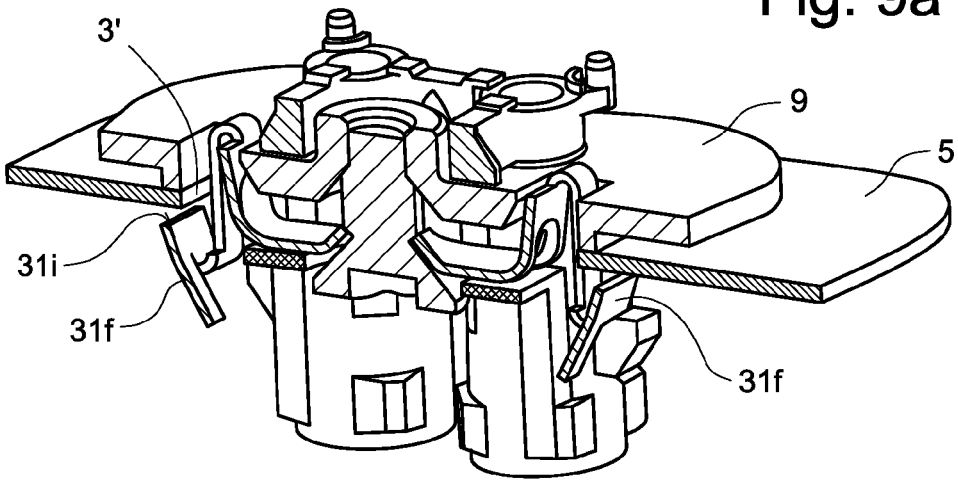
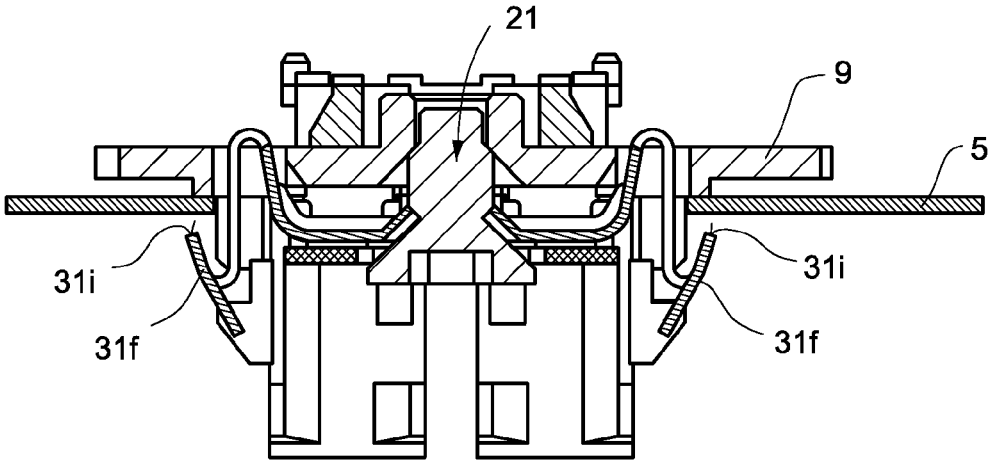
Fig. 9b

Fig. 10a
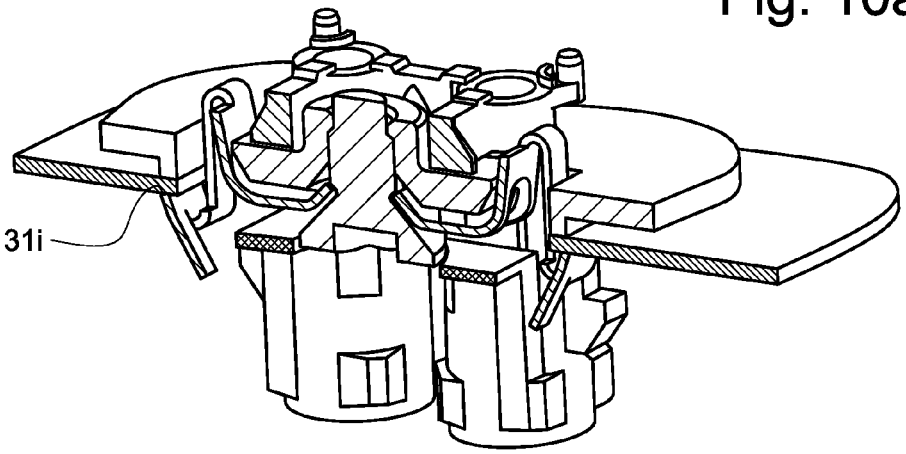
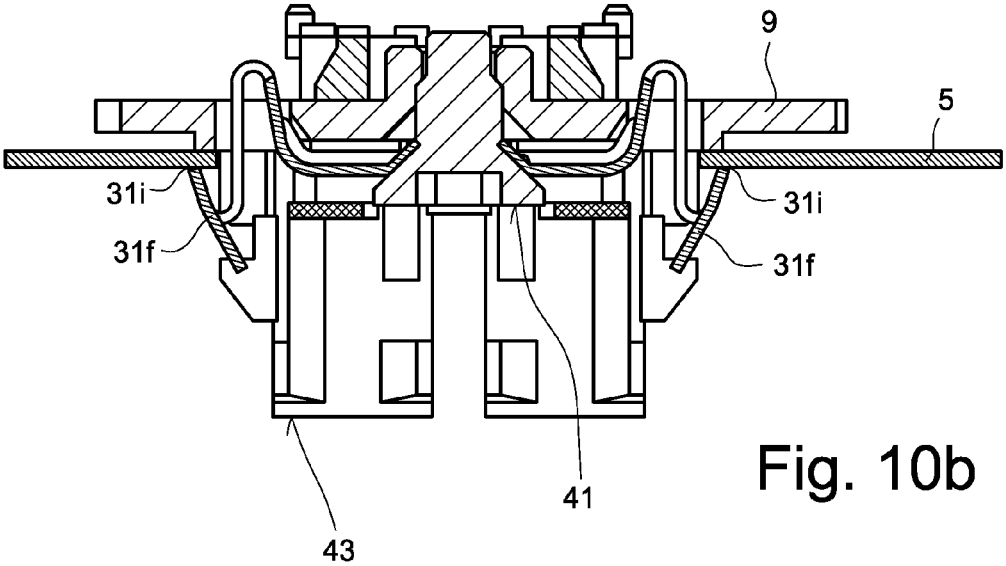
Fig. 10b

DEVICE FOR FASTENING AN ATTACHED PART, IN PARTICULAR IN THE FORM OF A MOTOR VEHICLE ANTENNA

CROSS-REFERENCES TO RELATED APPLICATIONS

None

STATEMENT REGARDING FEDERALLY SPONSORED RESEARCH OR DEVELOPMENT

None

FIELD

The technology herein relates to a fastening device, in particular for a motor vehicle antenna.

BACKGROUND AND SUMMARY

A large number of fastening means, in particular for fastening motor vehicle antennas to an opening in a bodywork, have already become known.

EP 0 758 802 B1 discloses, for example, a rod-shaped motor vehicle antenna. On a foot part of a motor vehicle antenna of this type, there protrudes downward a threaded sleeve which can be passed through an opening generally in a motor vehicle bodywork part in the roof region. An antenna cable is guided laterally outward through the screw member provided with a longitudinal slot. A nut, which can be loosened from below, is used to fix the antenna to the bodywork part.

According to EP 0 891 002 B1 and DE 202 04 863 U1, there are provided in the bodywork roof two openings located offset to each other, the antenna being fixed, in the prior publication EP 0 891 002 B1, using a fastening means on the inside of the bodywork and there being guided through the second opening in the bodywork part a pin which is connected to the antenna foot and to which an antenna cable can be connected. The aforementioned pin is also used to fasten the antenna non-rotatably to the bodywork, as in the above-mentioned DE 202 04 863 U1.

One of the drawbacks of the above-mentioned antenna fastenings is that, after attachment to the bodywork roof, a counter-threaded member has in all cases to be screwed onto a threaded pin in order to ensure the fixing and securing of the antenna, a second bodywork opening with a pin guided therethrough being in some cases necessary to achieve non-rotational engagement.

DE 100 09 978 A1 also proposes a screw fastening using what is known as a central fastening means, although in this case with additional two-legged spring elements, the legs of which are guided together into the opening in the motor vehicle in the direction of the insertion movement of the fastening device and protrude beyond the cross-sectional surface of the device in such a way that they are compressed, on introduction into the opening in the bodywork, by a delimiting wall of the opening and recoil, after passing through the opening on the side of the opening in the bodywork that is remote from the vehicle antenna, in order to reach behind the opening in the bodywork. The antenna may thus be pre-adjusted. The screw member then has to be attached to the threaded pin and tightened.

A fastening device which is comparable or similar in this regard has also become known from DE 298 14 054 A1.

A means for fastening a vehicle antenna has also become known from DE 202 03 914 U1. In this case, use is made of a locking support which is inwardly resiliently pre-pressed, on insertion of the fastening means through an opening in the motor vehicle, and, once it has passed through the opening in the bodywork, springs outward again and/or encompasses the edge of the opening in the bodywork on the side opposing the base plate or the foot part of the antenna. Compared to the aforementioned prior art, this embodiment is configured in such a way that a screw for holding the fastening means is already pre-fitted and rests on a side, remote from the antenna, of a peripheral annular edge of a locking support. After the above-described pre-fitting, the screw is then tightened, wherein outer locking support elements which are capable of spreading and comprise a stepped shoulder come to rest against the bodywork metal sheet and are supported thereon. Through the fastening means itself are guided cables laid therethrough which do not have any interface in the region of the fastening device.

A fastening device largely similar to this prior art has also become known from the generic prior art according to DE 10 2005 029 686 A1. The device for fastening an antenna comprises in this embodiment one or more axial plug connectors which are configured at the corner points of a square or rectangular housing portion of a first fastening means. In the center there is a sleeve which is provided with longitudinal slots and extends away from the foot part of the antenna. Attached to this sleeve is a second fastening means provided with laterally protruding legs which can be supported on the side of the bodywork metal sheet opposing the foot part of the antenna if a corresponding screw is introduced into a central opening in the second fastening means and is screwed, on the underside of the foot part, into a counter-thread and fastened therein. In order to make the overall construction of the fastening means at least comparatively compact, the aforementioned sleeve protrudes, from the underside of the fastening means, away from the foot part and ends in a plane more remote than the opening or insertion region of the exposed plug connectors. The cup-shaped second fastening means to be attached and the screw to be screwed therein further increase the height of the overall construction of the central portion, protruding far beyond the opening and insertion region of the plug connectors.

Exemplary illustrative non-limiting implementations herein provide an improved device, in particular for a motor vehicle antenna, which provides in the region of the fastening means plug connectors which are preferably of standardized configuration, for example in accordance with the standardized FAKRA system, while at the same time minimizing the fitting and overall volume. Preferably, the fitting opening in the motor vehicle roof should be as small as possible, wherein it should also advantageously be possible to configure the solution in the manner of a central fastening.

An exemplary illustrative non-limiting implementation provides a fastening device, in particular for fastening motor vehicle antennas in a motor vehicle bodywork, i.e. at a comparatively small through-opening, although, within the scope of the fastening device, one or more screened or unscreened plug connectors comprising one or more lines can also be provided. The exemplary illustrative non-limiting implementation system is particularly suitable for using standardized FAKRA RF plug connectors.

The central fastening system, which has in the past proven advantageous, is maintained.

It is also possible to fasten an attached part, in particular in the form of a motor vehicle antenna, using "one-hand fitting", i.e. using pre-locking, for example, to the vehicle roof. Elements which are separate to the handling of the components of the antenna fastening such as nuts, screws, clamping means, etc., which are connected non-rigidly and therefore non-detachably to the attached part to be attached, in particular in the form of the antenna, are avoided.

In particular, exemplary arrangements can provide a central fastening allowing direct contacting using an SMD-mountable plug connector system, preferably in the manner of a multiple FAKRA connector. The arrangement and orientation of the plug connectors can in this case be configured, for example, to a minimum axial distance dimension (of, for example, 10 mm) required for the insertion of individual FAKRA contacts, which dimension corresponds to the standard on which the FAKRA plug-in system is based (DIN 72594-1 "50 ohm high-frequency interface for road vehicles"). The requisite overall space is determined in this case by the geometry of the sockets which are larger than the connectors.

The orientation or alignment of the individual plug connectors can in this case be such that the individual FAKRA plug connectors can be inserted and detached independently of one another (when unlocked and removed appropriately).

In the case of the above-mentioned plug connectors according to the standardized FAKRA system, a solution comparable to the present invention cannot, per se, be carried out, as no free space remains for the integration of a central fastening.

In principle, it would be conceivable to provide mechanical fastening elements externally to the plug connectors. However, this would lead to a marked increase in the overall space required and to a fitting opening which would necessarily have to be enlarged in the vehicle roof.

An exemplary illustrative non-limiting implementation, on the other hand, proposes the provision of crucial parts for the central opening (i.e., in particular, the tensioning elements for tensioning the fastening means) in the region of the fitting opening (in particular an opening in the bodywork) and/or in a plane and/or a region which is closer to the attached part, in particular in the form of the motor vehicle antenna, than that plane in which the insertion opening in the one or more plug connectors comes to lie. In other words, the insertion opening in the plug connectors is more remote from the attached part, in particular in the form of the motor vehicle antenna, than the crucial parts for the central fastening, i.e., in particular, the tensioning elements required for the central fastening and/or the threaded member acting on the tensioning elements.

In an extreme case, provision may even be made, in an exemplary illustrative non-limiting implementation, for the parts crucial for the central fastening (such as, for example, tensioning elements, a tensioning or locking clip, etc. and/or a fastening screw) not actually to pass, based on the fitting direction, through at least part of the fitting opening, but rather merely to reach behind the edge of the fitting opening with their clamping and fastening portions, which penetrate this fitting opening, as a result of which the attached part is held. In this case, even the plane defined by the position of the insertion opening in the one or more plug connectors can come to lie in immediate proximity to the plane of the fitting opening. In the extreme case, the plane defined by the position of the insertion opening in the one or more plug connectors can be located, based on the fitting and insertion direction, even before the fitting opening, i.e., in particular, if, for example, a fitting plate or a chassis of the attached part (preferably in the form of the motor vehicle antenna) has a corresponding area, facing the surface of the bodywork, or a corresponding chamber for receiving the plug connectors. In other words, the crucial parts of the clamping elements, starting from the base plate or the chassis of the attached part, can come to lie merely at a partial height of less than 90%, in particular of less than 80%, 60%, 50%, 40%, 30% and even of less than 20% or 10%, so the plug connectors protrude beyond the central fastening and their corresponding tensioning elements exceed a multiple and the total space is available when attaching sockets, etc. to the plug connectors.

In other words, it is proposed, in an exemplary implementation, that the portion of the central fastening that is accessible for the purposes of handling during fitting (i.e. the screw of the central fastening) is moved out, during tightening, from the region of the socket contacts that is required in the inserted state of contacts inserted into the contact connectors. The portions of the central fastening that are crucial for handling are therefore located in a lower plane compared to the "plug connector or socket plane". Specifically, this means that the socket contacts, located for example on a cable harness, cannot be attached to the plug connectors until the end of the fitting of an antenna. However, this corresponds to the conventional fitting sequence for the strip installation of a roof antenna and ensures that the antenna is properly installed.

The fitting parts actually required for clamping an antenna (for example in the form of elastically deformable support elements, spring metal sheets and/or clamping parts) are located, in an exemplary non-limiting arrangement, in a plane or in a region which comes to lie, in the fitting or insertion direction, offset to the plane of the insertion opening in the plug connectors by the overall height or at least the axial partial height of the plug connectors, i.e. below the insertion opening in the plug connectors. It is therefore preferably provided for merely the fastening screw to be located, in the pre-fitted state before the final tightening with its screw head, even further away from the attached part (preferably the motor vehicle antenna) and to reach into the region of the sockets to be attached or the socket plane. However, as soon as the antenna fastening device has been inserted in the fitting opening in the motor vehicle roof, has been pre-engaged by the tensioning elements and has been fixed by tightening the fastening screw, the total insertion height of the sockets to be connected to the plug connectors is available again. Corresponding codings, for example in the form of outer longitudinal ribs, can in this case be connected to the plug connectors or to the housing or insulating part connecting the plug connectors, so only a fitting, associated counter-plug connector can ever be attached and therefore connected to a specific plug connector.

The above-mentioned codings or guides, i.e. what are known as coding ribs, are in this case configured on a plug connector, preferably from the insertion upper side, to begin with only over a partial height, of for example at least 3.5 mm, of the plug connectors, so in this case there is sufficient adjustment height for the fastening screw, so as to be able to screw said fastening screw from its pre-fitted state (allowing the fastening means to be inserted through the fitting opening in the motor vehicle roof) up to its final fitting position.

As the above-cited standard, which is fundamental to the FAKRA plug-in system, defines these coding guides or coding ribs as being required only in the upper 3.5 mm region extending from the insertion upper side downward to the base of the connector, it is admissible to dispense in this way with this geometry in the region located therebetween. The head of the fastening screw is therefore able to move in the free space thus produced. In addition, a partial segment of the cylindrical plug coding can also be omitted if necessary.

The requisite screw-in distance of the screw is obtained from the addition of the biasing or tensioning region of the resiliently configured tensioning elements of the central fastening, the compression region of the sealing elements of the antenna between the antenna foot and vehicle skin, the difference in the differing thicknesses to be compensated of the vehicle skin (or in the clamping region of the vehicle roofs) and the requisite distance for securely locking behind the clamping elements, which are preferably configured in the form of a spring metal sheet, when pre-locking the antenna (thus facilitating what is known as "one-hand fitting").

In a further exemplary illustrative non-limiting implementation, the extremely low overall height of the fastening device, in particular for fastening the motor vehicle antenna, is fulfilled in that some of the components required for the central fastening protrude through corresponding openings in the foot part, i.e., in particular, in the base plate or the chassis of the antenna in the interior of the antenna, i.e. in that area between the underside of a printed circuit board and the inside of the chassis.

The resilient tensioning elements are preferably formed from metal, for example from a spring metal sheet.

The selection of this material allows the force which is generated during fitting (for example, of the roof antenna) and with which the antenna is drawn onto the vehicle roof to be kept almost constant independently of thermal or mechanical environmental influences (which act on the antenna or mechanical fastening during the course of the life cycle of the vehicle). This distinguishes the exemplary non-limiting fastening device from the solutions previously known in the art, in particular from those solutions in which the fastening or biasing elements used are components made from plastics material which yield over time to contact pressures on account of material ageing in conjunction with the above-mentioned environmental influences (i.e. generate a relaxing of the tensioning elements). This would result in a decrease in the contact pressure of the motor vehicle antenna to be fastened on the vehicle outer roof and thus also in the sealing effect of the sealing elements provided.

Within the scope of the invention, an exemplary illustrative non-limiting implementation is possible which takes account of the requirement for non-detachable components of the central fastening. In an exemplary illustrative non-limiting implementation, this is achieved in that the individual components of the fastening (such as, for example, the tensioning elements, pressure parts or pressure screws, etc. which consist of a spring sheet metal) are connected to one another in an interlocking manner or are connected to one another, by screwing in the screw, in a movable but non-detachable manner.

In a further exemplary illustrative non-limiting implementation, it is also been found to be advantageous for a surrounding or coding housing used (for example, corresponding to the FAKRA standard) to be locked, in the production sequence after the fitting of the fastening elements, onto the plug connectors, so the central fastening located therebelow cannot fall out even if the screw member is unscrewed. This applies, in particular, even if the above-mentioned FAKRA plug connector system is used.

It has also proved to be particularly beneficial if differing possibilities can be provided for the central fastening.

Exemplary illustrative non-limiting implementations may use a tensioning means which, as a result of the material used, the material thickness, the material shaping, etc., is formed and shaped in such a way that it meets the conflicting requirements placed on a locking and/or tensioning element. These requirements entail, firstly, the provision of a tensioning means comprising a comparatively soft or resilient component for reducing the contact force required during fitting of the antenna for pre-locking the antenna in a securing opening (for example, an opening in the bodywork) on the motor vehicle roof and, secondly, a comparatively hard and stable component (for transmitting the requisite high force) during final fitting for tensioning the antenna on the vehicle roof. It has been found in this case that a suitable geometric configuration, in particular, allows these requirements to be met.

If, on the other hand, still higher contact forces should nevertheless be necessary for fastening the attached part, in particular in the form of the antenna (in the case of which forces, an acceptable compromise between resilience and hardness is not possible owing to the geometric configuration of the tensioning means, preferably in the form of a spring metal sheet, for example by embossing, forming points of increased rigidity and on comparatively more resilient portions), these increased external forces are achieved by the use of an additional pressure part which cooperates with the comparatively more resilient tensioning means.

BRIEF DESCRIPTION OF THE DRAWINGS

These and other features and advantages will be better and more completely understood by referring to the following detailed description of exemplary non-limiting illustrative embodiments in conjunction with the drawings of which:

FIG. 6 is a simplified spatial illustration of the fastening device prior to fitting in a through-opening in a motor vehicle bodywork;

FIGS. 8*a* and 8*b* are a spatial illustration and cross section at the time of the attachment of the fastening means in a through-opening;

FIGS. 9*a* and 9*b* are a view corresponding to FIGS. 8*a* and 8*b* after the fastening means has passed through the fastening opening;

FIGS. 10*a* and 10*b* are corresponding views after the tightening of the fastening means;

FIG. 11 is a spatial, enlarged illustration of the spring clip or spring metal sheet of the fastening means;

FIG. 12 is a view from below of the spring clip or spring metal sheet according to FIG. 11;

DETAILED DESCRIPTION

There will be described hereinafter an exemplary illustrative non-limiting first embodiment of a device for fastening an attached part 1, in particular in the form of a motor vehicle antenna, which is to be fitted at a fitting opening 3 in a fitting wall 5, preferably in the form of a bodywork metal sheet.

Figure 1:
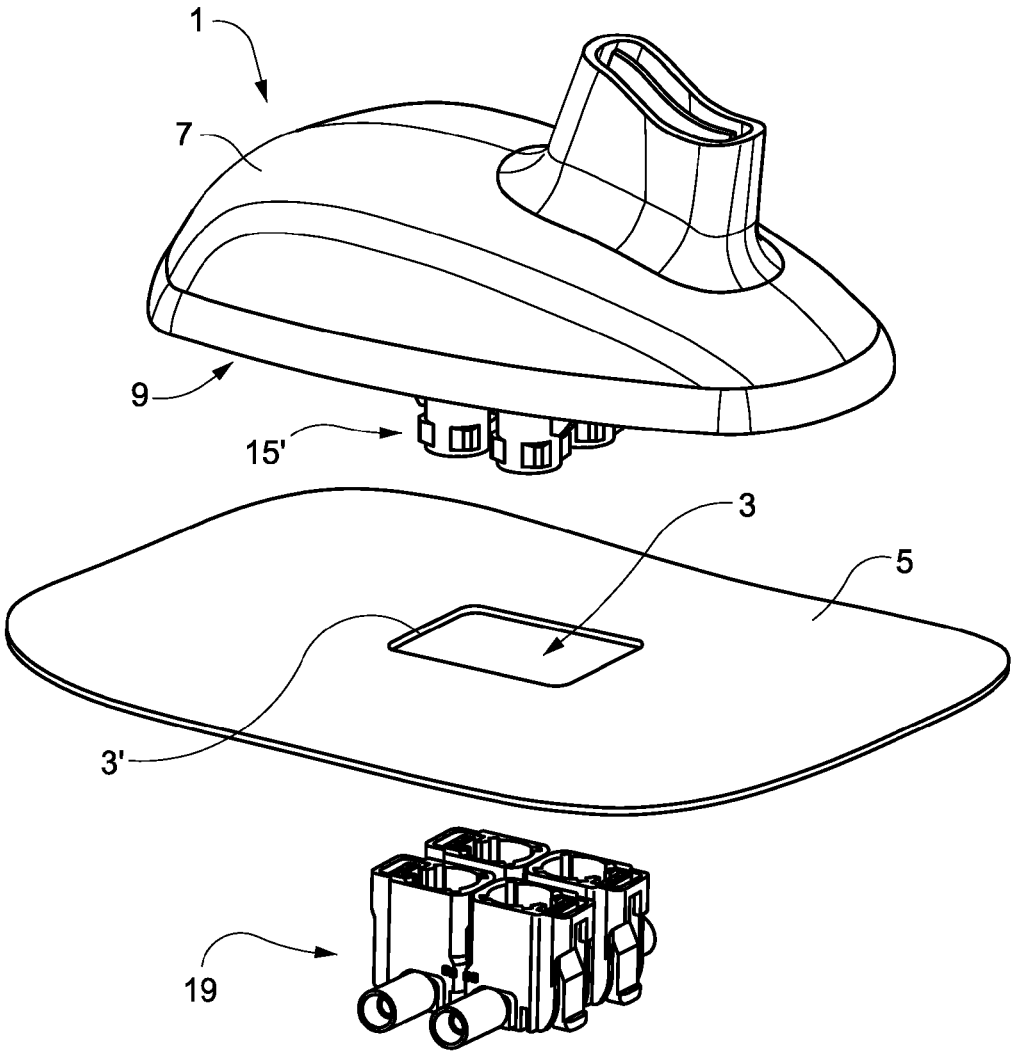
FIG. 1 is a schematic spatial illustration of a foot or housing part of a motor vehicle antenna which is to be fitted at a through-opening at an opening in a bodywork.

FIG. 1 is accordingly a partial schematic, spatial illustration of the motor vehicle antenna 1 comprising a housing or a hood 7 below which there is provided a fitting plate or a chassis 9 which is sealed by the hood 7. The requisite electronics are accommodated in the interior, there having been omitted from the drawing a portion rising further upward of the housing cover 7 within which one or more antennas or antenna means are additionally accommodated and protrude further upward.

Figure 2:
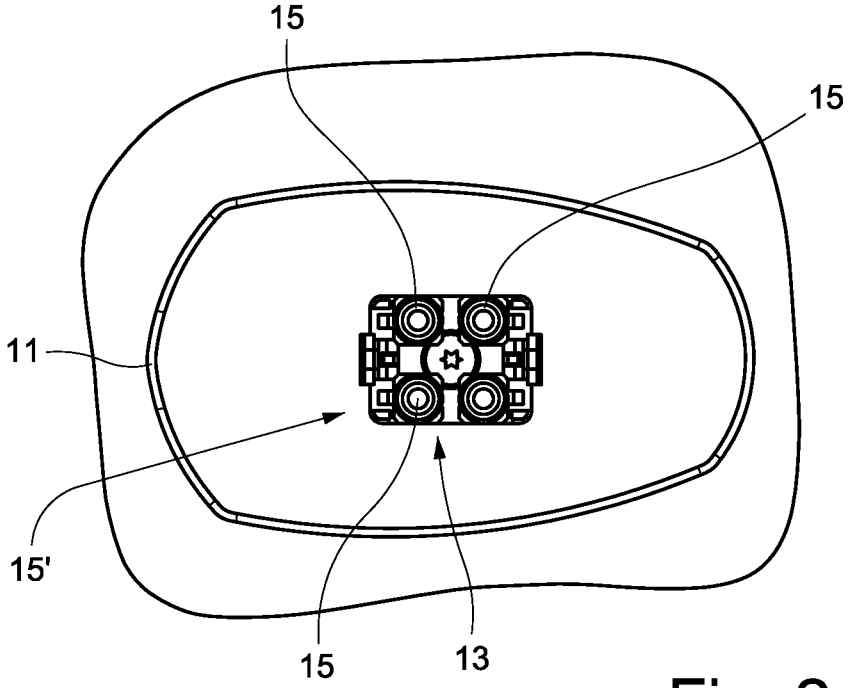
FIG. 2 is a schematic view from below of the embodiment according to FIG. 1 (with an additionally illustrated outer contour of the antenna which is already fitted to the bodywork)

FIG. 2 is a schematic view from below after fitting has been completed, there also being indicated the bordering or sealing of the chassis or of a seal 11 which is provided in the outer edge region and is per se not visible from the underside of the bodywork metal sheet 5. There protrudes through the fitting opening 3 a connector arrangement 13 comprising, for example, a plurality of plug connectors 15 having an associated plug connector housing 15', in the embodiment shown four plug connectors 15, which are arranged at the corners of a rectangle. These connectors may be screened coaxial connectors but equally non-shielded lines, wherein these plug connectors can comprise one or more lines or internal conductors. There is accordingly no limitation.

Figure 3:
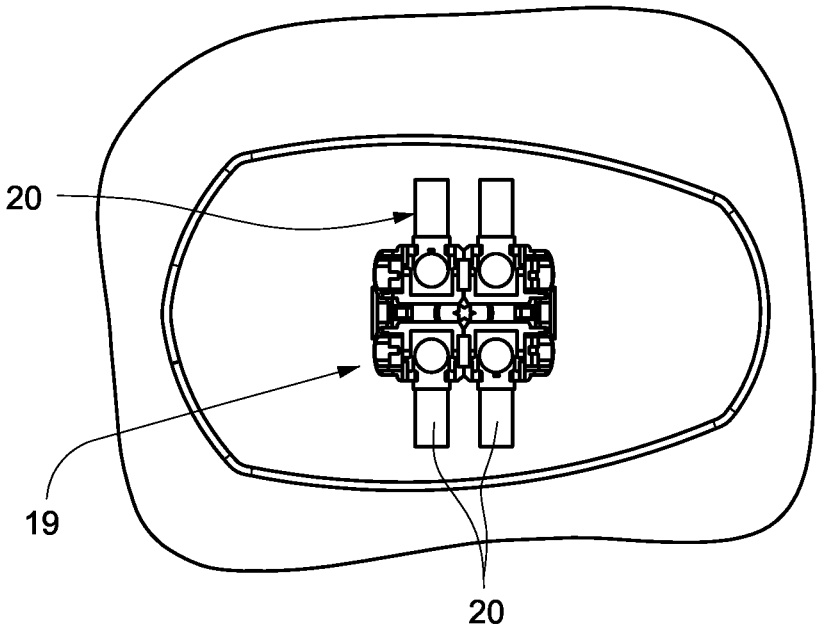
FIG. 3 is a corresponding view after the attachment of cable couplers or a socket housing onto the plug arrangement located on the underside or inside of the motor vehicle after the insertion and fitting of the motor vehicle antenna.

FIG. 3 represents a view corresponding to FIG. 2, although in this case there are also attached cable couplers referred to hereinafter in some cases as the coded cable coupler housing 19. In this embodiment there are also provided cable connections 20 to the cable couplers 19, which connections project transversely but do not have to be provided.

The plug connectors 15 may preferably be plug connectors which adhere to the FAKRA standard. The system may therefore be an SMD-mountable FAKRA plug-in system 17 which embodies the aforementioned plurality of plug connectors 15 in accordance with DIN Standard 72594-1 "50 ohm high-frequency interface for road vehicles". This system is configured for the insertion of individual FAKRA contacts having a requisite minimum axial distance of 10 mm.

Figure 4:
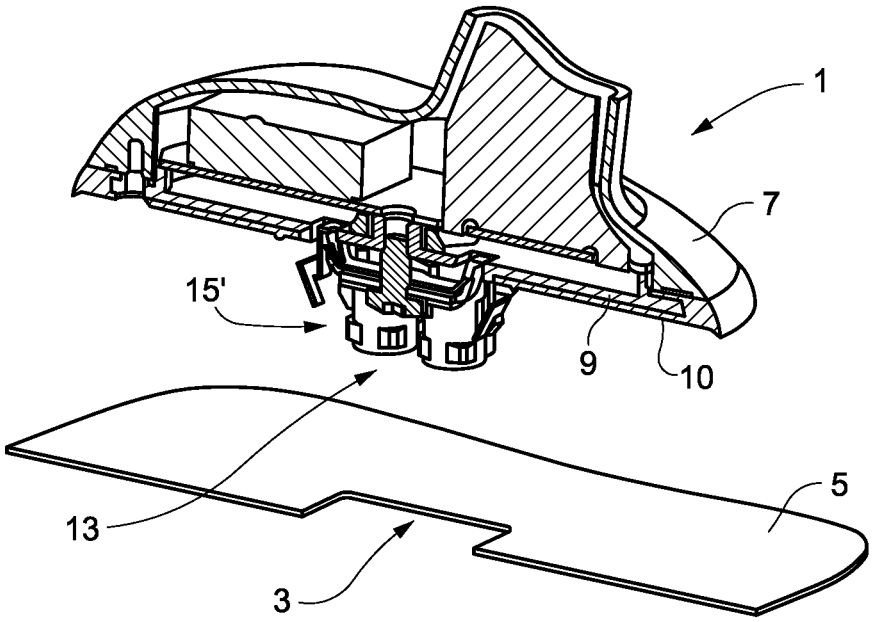
FIG. 4 is a similar view corresponding to FIG. 1, but in vertical section.

FIG. 4 represents a view corresponding to FIG. 1, in vertical section. FIG. 4 also shows the fitting plate or the chassis 9 in cross section together with a plastics material casing and/or sealing means 10 facing the bodywork metal sheet 5.

Reference will be made hereinafter to FIG. 6 and following. which illustrate the fastening system in greater detail.

FIG. 6 shows, again in detail, the wall, in particular in the form of the bodywork metal sheet 5 comprising the fitting opening 3. Of the attached part, preferably in the form of the motor vehicle antenna 1, there is merely reproduced a detail of the fitting plate or the chassis 9 in which the aforementioned plug-in system is installed and fitted.

The further illustrations show the further construction and the fitting process in detail.

Figure 7A:
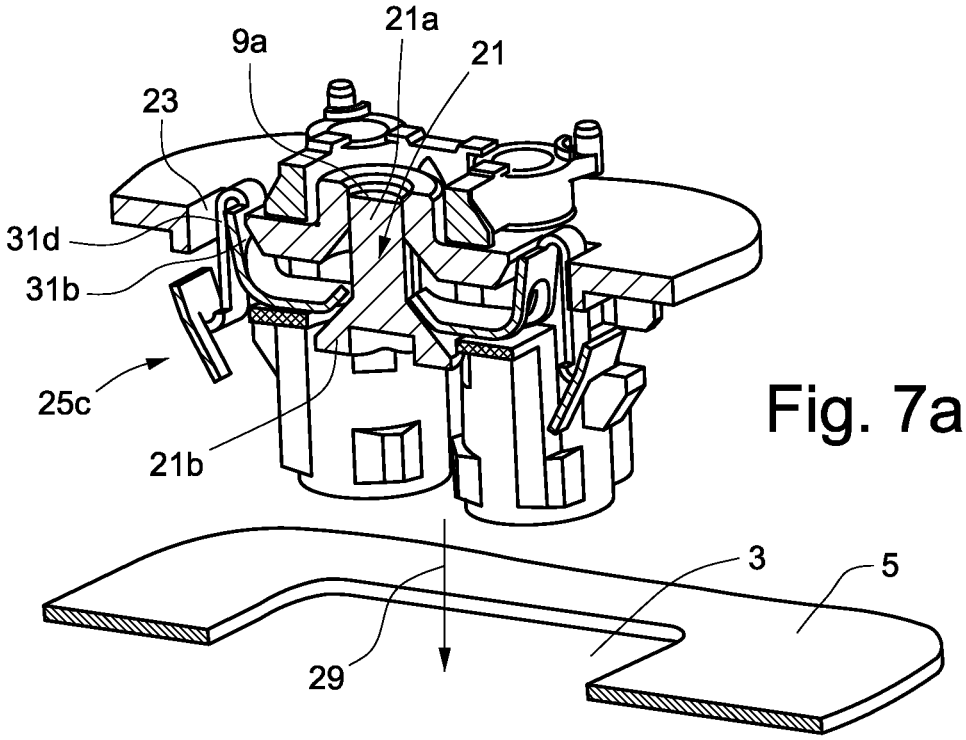
FIG. 7*a* is a view corresponding to FIG. 6, in vertical section.
Figure 7B:
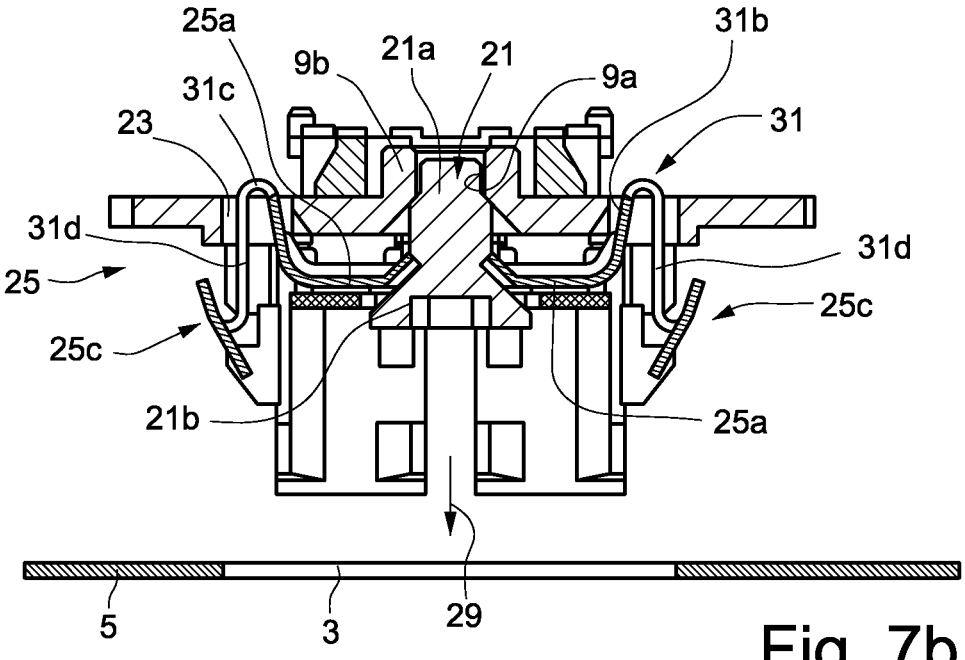
FIG. 7*b* is a cross section through the example according to FIG. 7*a;*

As may be seen, in particular, from the illustrations according to FIGS. 7*a* and 7*b*, the fastening means comprises a fastening screw 21, the shank 21*a* of which is screwed into a threaded hole 9*a* in the chassis 9. This threaded hole 9*a* is provided with a corresponding internal thread and comprises a receptacle, in the form of an opening penetrating the fitting plate 9 in the embodiment shown, into which opening the shank of the fastening screw 21 is screwed. In order to ensure a sufficiently secure fit, the fitting plate 9 is provided in this region with a sleeve-like extension 9*b* projecting away from the fitting wall 5.

Also provided in the fitting plate 9, in the embodiment shown, are apertures 23 opposing the fastening screw 21 (offset to one another by an angle of 180°).

As may be seen from FIGS. 7*a* and 7*b* there is also provided a tensioning or locking means 25 also referred to hereinafter in some cases as the spring metal sheet or spring clip. This spring metal sheet or spring clip may be seen in greater detail in FIGS. 11 and 12 which show that this tensioning or locking means 25 comprises a central portion 25*a* provided with an opening 25*b* through which the aforementioned fastening screw 21 is inserted. Provided opposing the central opening 25*b* are clamping and locking portions 25*c* which are oriented so as to diverge counter to the direction of insertion, as indicated by arrow 29.

These clamping and locking portions 25*c* are connected to the central portion 25*a* via a double V-shaped, S- or Z-shaped spring construction 25*d*, so in other words the central portion 25*a* merges, via a first angled portion 31*a* leading toward the attached part 1, with a subsequent leg portion 31*b* which merges, via a subsequent angled portion 31*c* (which almost forms a 180° deflection), with an adjacent leg portion 31*d*, at the free end of which there is then formed a further angled portion 31*e* which also produces an almost 180° deflection and ends in a clamping bearing portion 31*f*.

In the embodiment shown, provided adjacent to the opening 25*b* in what is known as the spring metal sheet or spring clip 25 is a funnel-shaped recess 25*e*, the configuration of which corresponds to the underside of the head 21*b* of the fastening screw 21 which tapers in this case conically from the point of transition between the screw head and shank. In order to ensure, on the one hand, sufficient rigidity or else, on the other hand, desired resilience at various portions of this clamping and/or locking means 25, longitudinal ribs and/or recesses 25*g* or other embossed portions and/or measures can be provided, for example, in the region of the central portion 25*a*. In order to ensure increased resilience in the region of the clamping feet 31 thus formed (also referred to hereinafter in some cases as the clamping and support elements), there is provided in this case a central material portion comprising a recess 31*h*, a portion of the punched-out material being in the form of a web 31*j* which protrudes, i.e. projects from the clamping and bearing portion 31*f*.

The illustration according to FIGS. 7*a* and 7*b* shows the attached part 1, in the form of the motor vehicle antenna 1, prior to its pre-adjustment and fastening in the fitting opening 3.

FIGS. 8*a* and 8*b* show how, on further insertion in the fitting or insertion direction 29, the outer clamping and/or run-on faces 31*f*, which extend toward one another in the insertion direction, extend to the edge 3' of the fitting opening 3. When the attached part 1 is pressed in further using the fastening means, these clamping and/or run-on portions 31*f* are pressed by the edge 3' of the fitting opening 3 further inward toward the fastening screw, the clamping forces being increased, as the leg portions 31*b* and 31*d* are in this case increasingly pressed toward one another.

During the further insertion movement, the edge 3' slides along the clamping and/or run-on face 31*f* until the trailing edge 31*i* of these clamping and/or bearing portions passes the edge 3' of the fitting opening 3 and the resilient clamping forces of the fastening means then cause the clamping and/or abutment portions 31*f* to spring outward again, as shown with reference to FIGS. 9*a* and 9*b*.

The prerequirements for one-hand fitting are thus met, as after the fastening means thus constructed has been passed through and the clamping and bearing portions 31*f* have reached behind the fitting opening 3, the motor vehicle antenna 1 is held non-detachably in the fitting opening 3 in the motor vehicle bodywork 5.

The fastening screw 21 is then tightened until it engages using a suitable tool, for example in the form of a screwdriver, as shown with reference to FIGS. 10*a* and 10*b*. The trailing edge 31*i* enters, in this case, into contact with the underside or inside 5*a* of a motor vehicle interior of the bodywork metal sheet 5 even before the fastening screw has been fully screwed in. When the fastening screw 21 is further tightened, the central portion 25*a* of the spring metal sheet or spring clip 25 is then moved increasingly toward the underside of the fitting plate 9, increasingly high clamping and tensioning forces being generated via the clamping feet 31 and the clamping support formed by the trailing edge 31*i*, which rest on the underside of the fitting wall 5. In this position, the fastening means is then held securely and without risk of slippage.

Once the fastening screw 21 has been tightened, the downwardly pointing upper side of the fastening screw 21, i.e. the screw head 21*b*, comes to lie in a plane 41 which is located much closer yet to the fitting plate 9 or to the fitting wall 5, i.e. the distance thereof from the plane 43, formed by the insertion opening 15*a* in the plug connectors 15, is even greater.

Once the screw 21 has been tightened for securing the motor vehicle antenna in the fitting opening 3, the aforementioned cable coupler 19 can then be attached to the plug connectors 15, there being sufficient space for this purpose without the fastening means comprising the tensioning and/or locking means 25 and the fastening screw 21 adjusting the requisite fitting space.

Figure 13:
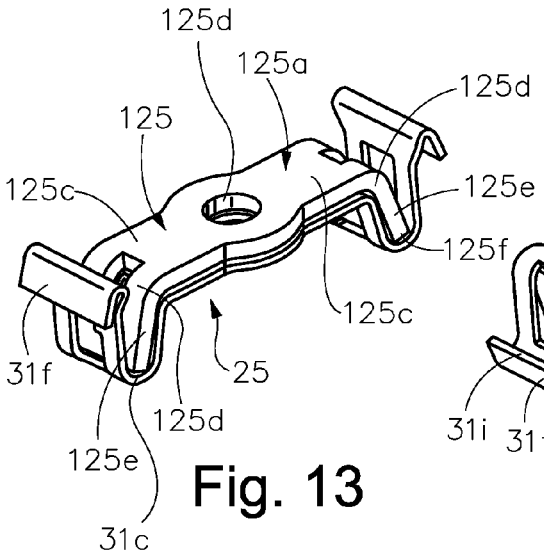
FIG. 13 is a view corresponding to FIG. 11 with regard to a modified embodiment comprising an additional pressure part which cooperates with the spring metal sheet or spring clip.
Figure 14:
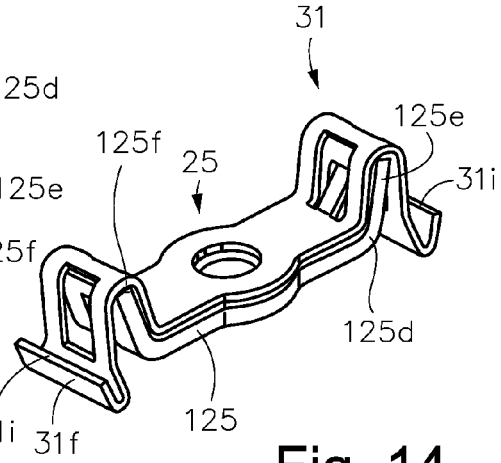
FIG. 14 is a corresponding view of the embodiment according to FIG. 13, but from the opposing side.

In order, if necessary, firstly to ensure sufficient resilience for the tensioning means comprising the spring metal sheet or the spring clip 25, but secondly also to ensure, when tightening the fastening screw, that the high securing forces are as effective as possible in order to hold and to fix the attached part in question using the fastening means, it is shown, in accordance with a modified embodiment illustrated in FIGS. 13 and 14, that there may also be provided, in addition to the spring metal sheet or spring clip 25 itself, an additional pressure part 125.

The pressure part 125 also has a central portion 125*a* comprising a central opening 125*b* to which there are connected two opposing pressure portions or pressure arms 125*c* which merge with a subsequent bend 125*d* and subsequent pressure-transmitting arms 125*e* angled toward the fitting plate. The end of these pressure-transmitting arms 125*f* comes to lie, in this case, between the two leg portions 31*b* and 31*d* of the clamping feet 31 of the spring metal sheet or spring clip 25.

In this embodiment, the selection of an appropriate material, shaping, etc. allows the leg portions and angled portions of the clamping feet 31 to be configured in such a way that, in this case, the resilient evasion movement takes place more easily, generating lower spring forces, when the fastening means is attached, i.e. when the clamping bearing portions 31*f* pass through the fitting opening 3. However, when the fastening screw 21 is tightened, the ends 125*f* of the pressure part 125 then abut, between the respective pairs of leg portions 31*b* and 31*d*, the angled portion 31*c* located therebetween, so during the course of the securing movement of the securing screw increasingly high contact forces are exerted on this angled portion 31*c* and thus, counter to the fitting direction 29, the leg portions 31*d* leading to the clamping bearing portions 31*f* are subjected to increasing tensile loads in the tightening direction.

A construction of this type allows for the requirement for corresponding resilience and optimally high transmission of compressive or tensile forces onto the clamping portions.

Figure 15A:
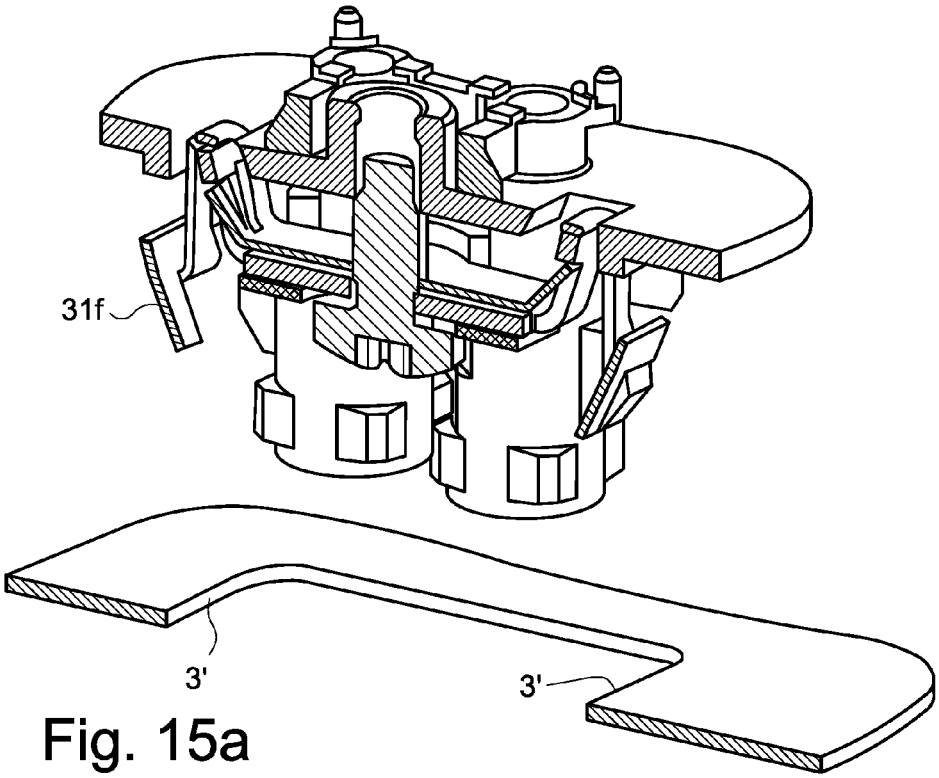
FIG. 15*a* is a corresponding view comparable to FIG. 7*a*, but using a pressure part corresponding to FIGS. 13 and 14.
Figure 15B:
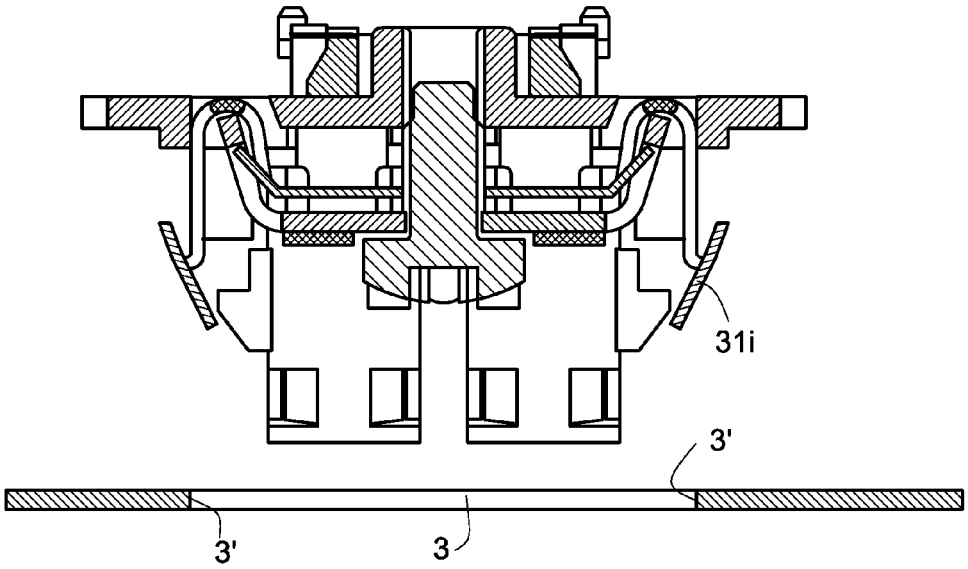
FIG. 15*b* is a cross section through the embodiment according to FIG. 15*a*, comparable to the embodiment according to FIG. 7*b;*
Figure 16A:
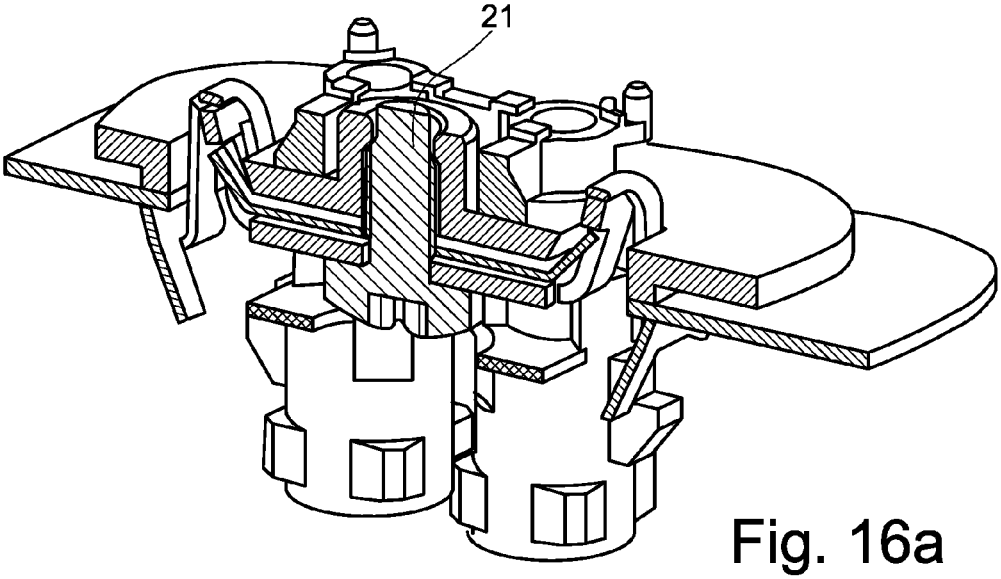
FIG. 16*a* is a spatial illustration of the tightened fastening means in a spatial cross section comparable to the embodiment according to FIG. 10*a;*
Figure 16B:
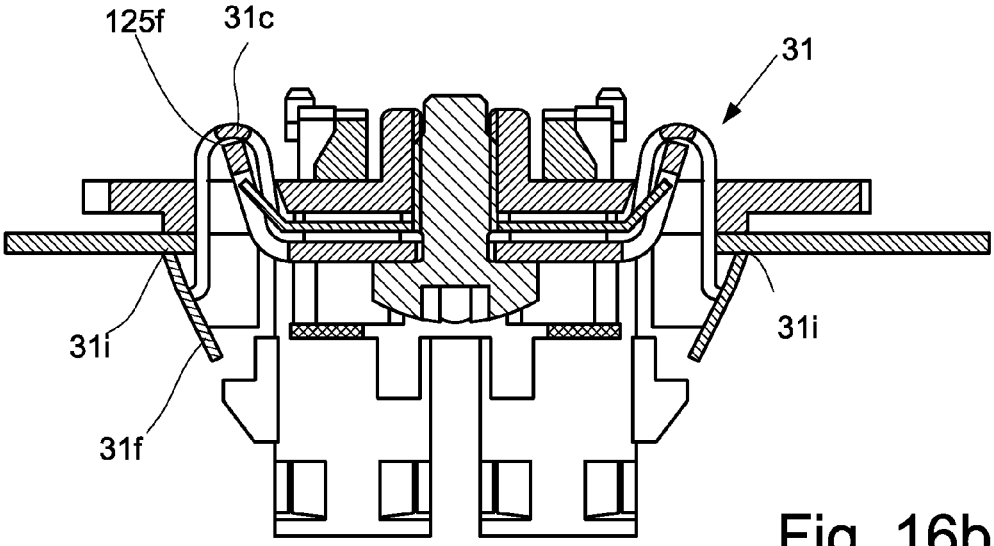
FIG. 16*b* is a cross section through the embodiment according to FIG. 16*a;*

FIGS. 15*a* and 15*b* show the situation with a spring clip 25 comprising an additional pressure part 125 prior to fitting, whereas FIGS. 16*a* and 16*b* reproduce the situation after the final pre-adjustment in the fitting opening 3 and the subsequent tightening of the screw 21. In this situation, the ends 125*f* of the pressure part 125 exert on the angled portion 31*c* of the spring clip 25 contact forces toward the motor vehicle antenna, via which the trailing edge 31*i* is pressed, via the subsequent leg 31*d* and the clamping and bearing portions, against the underside of the bodywork metal sheet 5 at higher contact forces.

Figure 17:
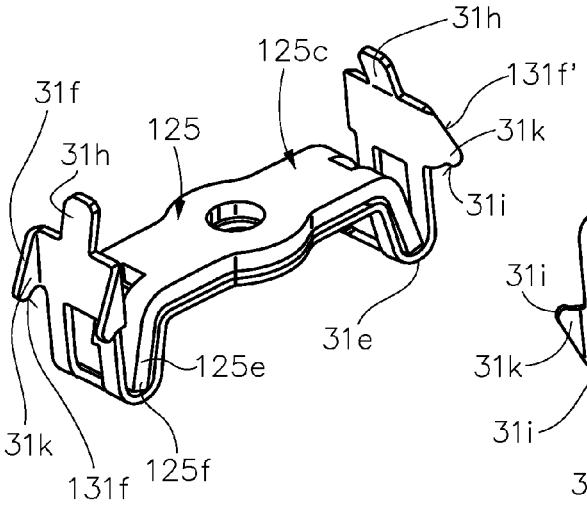
FIG. 17 is a perspective view of a modified embodiment of a spring clip or spring metal sheet with an associated pressure part.
Figure 18:
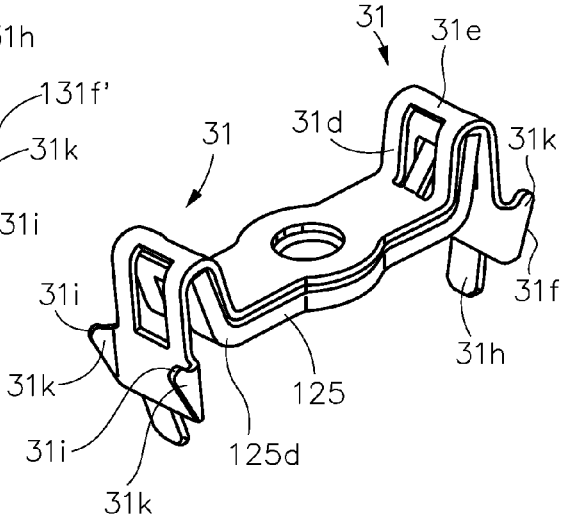
FIG. 18 is a view of the embodiment according to FIG. 17, but seen from the opposing side.

FIGS. 17 and 18 therefore show a further alternative with regard to the above-described embodiment, in which the clamping feet 31 are of modified construction. In this embodiment, these clamping feet 31 are formed substantially merely in a V-shaped or U-shaped or similar manner, wherein the clamping and bearing portion 131*f* itself does not comprise an angled portion further inverted compared to the angled portion 31*c*, but rather there are configured in this case clamping projections 31*k* which protrude transversely to the plane of the legs and the clamping edges 31*i* of the clamping or bearing portions 131*f* of which abut the underside of the fitting wall 5, i.e. the underside of the bodywork metal sheet arrangement 5 adjacent to the fitting opening 3. Further modifications are therefore possible.

Figure 5:
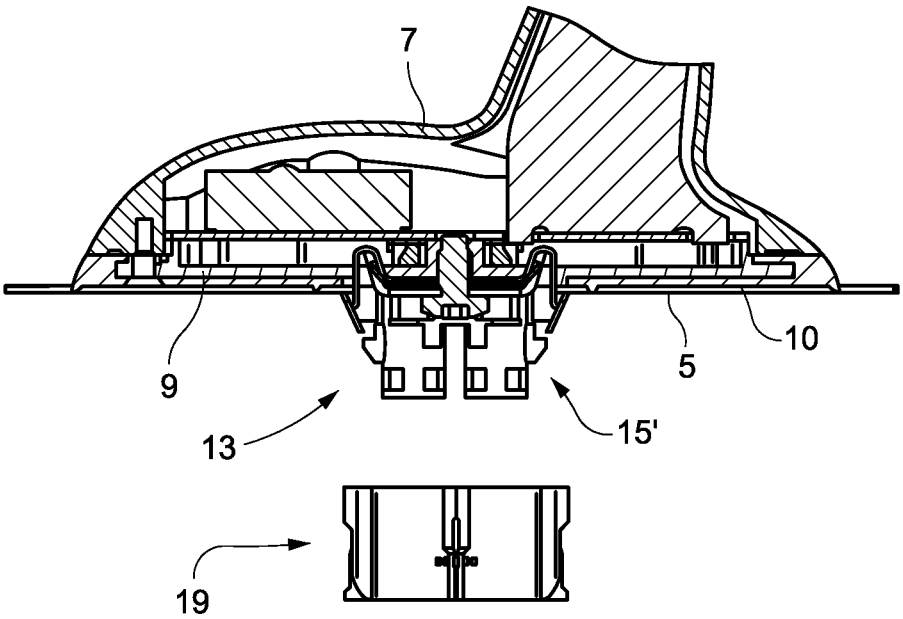
FIG. 5 is a cross section of the fully fitted motor vehicle antenna prior to insertion of the cable couplers onto the plug arrangement.

Once fitting has been completed, i.e. after the fastening screw 21 has been tightened, the entire height of the plug connectors is then available for contacting with the cable coupler to be attached or correspondingly shaped, further complementary plug connectors without the described fastening means thus contributing to an increase in the overall space. There can thus be attached to the plug connector housing 15' the cable couplers shown in FIGS. 1, 3 and 5, which are held non-detachably to the plug connector housing 15' by corresponding projections and recesses.

An in total low overall height can also be achieved in that the clamping feet 31 comprise one or more angled portions configured so as to protrude through an opening or through apertures 23 in the fitting plate or in the chassis 9, i.e. project counter to the fitting direction 29, and optionally protrude through the fitting opening 3 in such a way that the clamping edge 31*i* can be located at least approximately at the level of the central portion 25*c* of the spring metal sheet or the spring clip 25. In the extreme case, the central portion 25*c* can even be located further away from the insertion opening in the plug connectors, or even be located on the side of the bodywork metal sheet on which the attached part 1 is positioned, so substantially merely the clamping edges 31*i* protrude through the fitting opening and reach behind the fitting opening in order to rest on the fitting will 5. Overall, this configuration of the clamping feet can even allow the central portion of the spring metal sheet or the spring clip 25 to come to lie, viewed in the insertion direction, not only lower than the clamping edge 31 but also downstream, with regard to the insertion direction 29, i.e. even on the side opposing the fitting wall 5 provided with the fitting opening 3.

In conclusion, it will be noted that the pressure part 125 can also be provided with an internal thread, so the pressure part 125 is held, along with the spring metal sheet or the spring clip 25, non-detachably to the screw, i.e. cannot slide off from the shank, when the screw is screwed in.

The invention claimed is:

1. A device for fastening to an attached part including a fitting wall having a fitting opening therethrough and having a threaded portion, the device comprising:

a screw member comprising a screw head and further comprising a screw shank structured and dimensioned to engage with and threadably screw into the attached part threaded portion, a tensioning structure comprising at least one element structured and configured to tension the device toward the fitting wall, the at least one element structured and dimensioned for insertion through the fitting opening from an attachment side thereof, the at least one element comprising a locking structure structured to lock behind the fitting opening with the at least one element inserted through the fitting opening from the attachment side, a plug-in system comprising plural plug connectors having the screw member disposed therebetween in such a way that, when viewed perpendicularly to the fitting opening, the plural plug connectors are arranged wholly or partially in a region of the fitting opening, the plural plug connectors having insertion openings defining an insertion plane, the screw member being structured and configured to penetrate the tensioning structure and apply pressure to the tensioning structure to thereby urge the at least one element to be supported, on a side of the fitting opening opposing the attached part, on the fitting wall surrounding the fitting opening and thereby fix the device to the attached part, with the screw head applying pressure to the tensioning structure being further structured to be located closer to the fitting wall than the insertion plane defined by the insertion openings of the plural plug connectors, wherein, externally to a central portion of the tensioning structure, clamping feet structured from a spring metal sheet or spring clip are formed having, in side view, an S-shape, a U-shape or a V-shape in such a way that each of the clamping feet comprises at least two legs which are joined together via an angled portion protruding toward the attached part, at least a first of the two legs being configured to penetrate the fitting opening, and a clamping edge provided on a second of the two legs and configured to reach behind the fitting opening to abut an underside of the fitting wall, wherein the clamping edge is disposed at a free end of the second leg.

2. The fastening device as claimed in claim 1, wherein the tensioning structure defines a through-opening penetrated by the screw shank of the screw member, a central portion thus formed of the tensioning structure, comprising the spring metal sheet or a spring clip, being located in a region or in a plane positioned, in the insertion and fitting direction, after the plane in which the insertion openings in the plural plug connectors are located.

3. The fastening device as claimed in claim 1, wherein the clamping feet protrude at least partially through or into one or more apertures.

4. The fastening device as claimed in claim 1, wherein the central portion of the tensioning structure and the upper side of a screw head of the screw member being located in a region, at a level located sufficiently far below the insertion plane formed by the insertion openings in the plural plug connectors, to attach mating plug connectors to the plural plug connectors without the mating plug connectors colliding with the tensioning structure and the screw member.

5. The fastening device as claimed in claim 1, wherein the central portion of the tensioning structure is located in a region that is closer to the attached part than to the clamping edges which are supported in use on the fitting wall on a side opposing the attached part.

6. The fastening device as claimed in claim 1, wherein an upper side of the screw member is structured and dimensioned to lie at a distance from the fitting plate provided with the fitting opening that is less than 80% of the distance of the plane, formed by the insertion opening in the at least one plug connector, to the fitting wall.

7. The fastening device as claimed in claim 1, wherein the tensioning structure comprises in the central portion thereof ribs for increasing rigidity.

8. The fastening device as claimed in claim 1, wherein the clamping feet comprise ribs via which resilience of the clamping feet is defined.

9. The fastening device as claimed in claim 1, wherein the clamping feet are configured at each radially outer end of the tensioning structure.

10. The fastening device as claimed in claim 1, further comprising cable couplers attached to the plug-in system and secured thereon.

11. The fastening device of claim 1 wherein a top surface of the screw head is structured to be located in a plane which is closer to the attaching structure or the fitting wall, respectively, than to the insertion plane.

12. The fastening device as claimed in claim 1 wherein the clamping feet comprise raised portions.

13. The fastening device as claimed in claim 1 wherein the clamping feet comprise material cutouts.

14. The device of claim 1 wherein the central portion of the tensioning structure includes a funnel-shaped recess which corresponds to a portion of the screw head where the screw head tapers conically from a point of transition between the screw head and the screw shank.

15. The device of claim 1 wherein the central portion comprises longitudinal ribs and/or recesses that at least in part determine the rigidity and/or resilience of the spring clip.

16. The device of claim 1 wherein the plural plug connectors comprise four plugs and the screw head is disposed between the four plugs in a position that does not mechanically interfere with mating of the four plugs with four further mating pluggable connectors.

17. The device of claim 1 wherein at least one of the plural plug connectors includes a longitudinal coding rib that extends over only a part of the plug connector to thereby provide adjustment height clearance for the screw member.

* * * * *